United States Patent [19]

Bleich

[11] 3,955,337

[45] May 11, 1976

[54] APPARATUS FOR MANUFACTURING AND WRAPPING LABELS

[76] Inventor: Simon Bleich, 29 Gassergasse, A-1050 Vienna, Austria

[22] Filed: June 10, 1975

[21] Appl. No.: 585,569

[30] Foreign Application Priority Data

June 11, 1974 Austria ..... 4822/74

[52] U.S. Cl. ..... 53/123; 53/198 R; 83/214; 83/219

[51] Int. Cl.[2] ..... B65B 13/06; B65B 13/32; B26D 5/20

[58] Field of Search ..... 53/123, 198 R; 83/213, 83/214, 277, 219, 220

[56] References Cited

UNITED STATES PATENTS

| | | | |
|---|---|---|---|
| 2,433,535 | 12/1947 | Treis et al. | 53/123 X |
| 3,279,146 | 10/1966 | Ficht | 53/198 R |
| 3,336,826 | 8/1967 | Sheffield | 83/219 |
| 3,432,988 | 3/1969 | Minten | 53/198 R X |
| 3,466,833 | 9/1969 | Penrod et al. | 53/123 X |

*Primary Examiner*—Travis S. McGehee
*Assistant Examiner*—Horace M. Culver
*Attorney, Agent, or Firm*—Imirie, Smiley & Linn

[57] ABSTRACT

Apparatus for manufacturing and wrapping labels comprising blanking means for cutting blanks from a stack of sheets, punching means for punching the stacks of blanks, and wrapping means for wrapping stacks of labels. A table is provided which carries a conveyor. The table and conveyor serve to intermittently move a stack of sheets in two directions, which are at right angles to each other. Severing means are provided, which comprise a blanking tool and a punching tool, which act in a vertical succession. Wrapping means succeed the severing means and are disposed below the same.

9 Claims, 14 Drawing Figures

2
2'
3
27
29
28
36
7
33
9'
9
32
1
1'
42
4
5
6
5A
12
II
D
151
14
142
191T
182T
185T
193
94
24
13
137'
12
64
63
65
10
66
63
190T
70
117, 118
166
164
11
77
17
66
21
85
87
72
85'
87'
20
119
86
68, 69
96
70, 71
86'
26
91
18
C
19

APPARATUS FOR MANUFACTURING AND WRAPPING LABELS

SUMMARY OF THE INVENTION

Apparatus for making wrapping stacks of labels comprises a table and a carriage for intermittently moving a stack of paper in two directions which are at right angles to each other into the range of severing means disposed outside the table. The severing means cut blanks in rows from the stack and punch labels from the blanks at the same position. The labels are then caused to descend and are wrapped by wrapping means.

This invention relates to apparatus for manufacturing and wrapping labels by blanking means for cutting blanks from a stack of sheets, punching means for punching the stacks of blanks, and wrapping means for wrapping stacks of labels.

It is known to cut stacks of sheets of paper, paperboard, cardboard, metal foil and plastics material by blanking means into rectangular stacks of material and to feed the resulting stacks of blanks to separate automatic label-punching stations, on which they are placed before a feeder, which pushes the blanks of stacks to a position between a punch and die. The punched labels are then fed in the form of a continuous stack by a conveyor to automatic wrapping means, in which a separating blade is operated to sever individual stacks from the continuous stack, and each individual stack is wrapped with paper tape and pressure-sensitive tape. The wrapped stacks are then transferred to a packaging station.

This process has the disadvantage that separate automatic means are required to blank and punch the material and to wrap the stacks and that these automatic means require a large space and their operation is time-consuming. Besides, the known apparatus cannot be used to make very small labels.

It is an object of the invention to avoid the above-mentioned disadvantages and to provide an apparatus in which any or all operations can be selectively performed jointly and, if desired, automatically.

To accomplish this object it is a feature of the invention to provide a table which carries a conveyor, the table and conveyor cooperate to intermittently move a stack of sheets in two directions, which are at right angles to each other, severing means comprising a blanking tool and a punching tool, which act in succession, and wrapping means, which succeed the severing means.

Further details of the invention will be explained more fully with reference to the drawing, in which an embodiment of the present apparatus is shown diagrammatically and by way of example.

FIG. 1 is a front elevation showing the apparatus,

FIG. 2 a side elevation showing the apparatus viewed in the direction of the arrow II in FIG. 1, FIG. 3 a top plan view showing the apparatus, FIG. 3*a* a top plan view showing a corner portion of a stack which is to be blanked and punched, FIG. 4*a* an enlarged top plan view showing the blanking and punching means, and FIG. 5 a side elevation showing the blanking and punching means viewed in the direction of the arrow V in FIG. 4 and an enlarged view showing a portion of FIG. 1. In FIG. 5, parts have been omitted for the sake of clearness.

Figure 1:
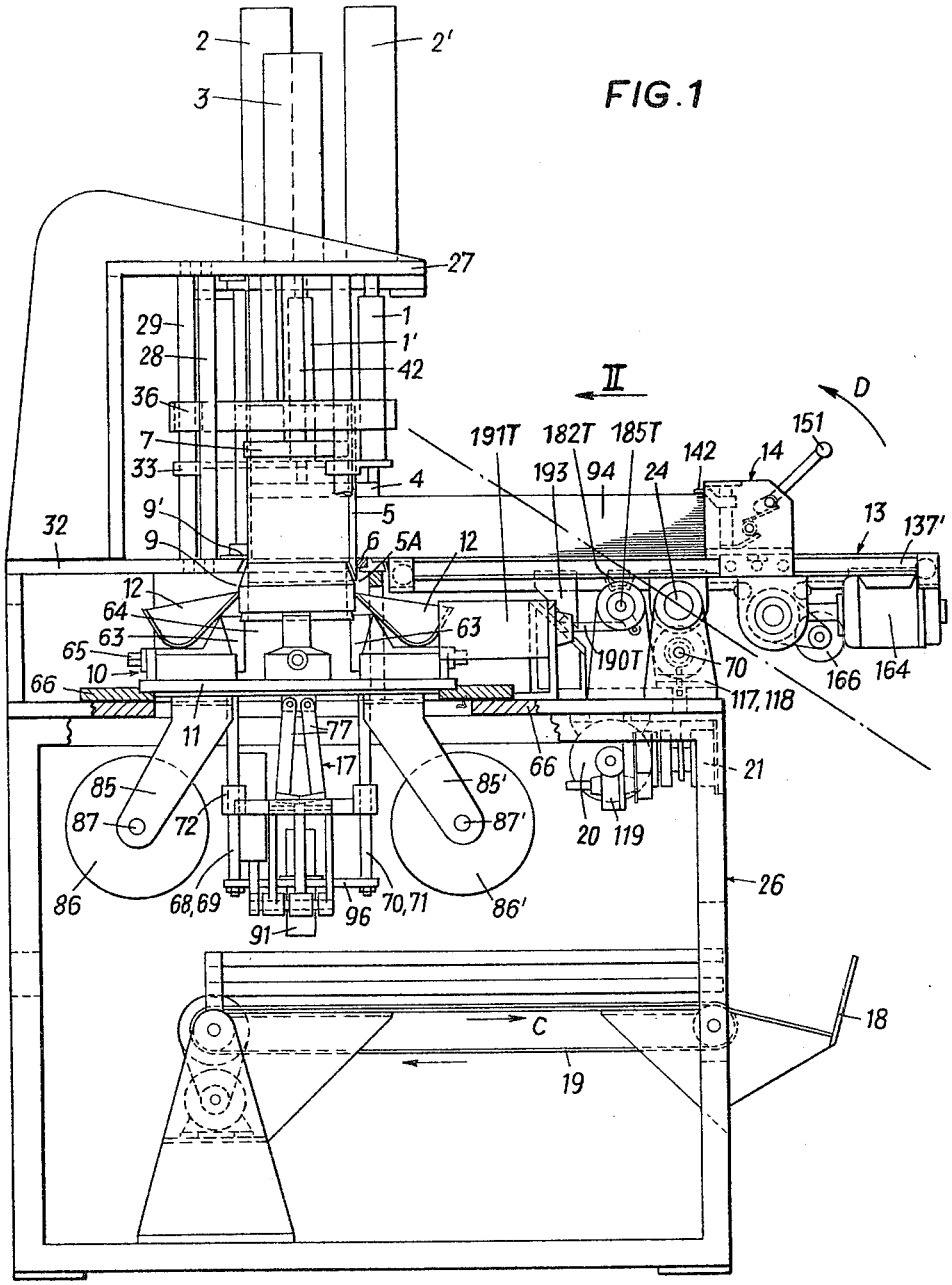
Figure 2:
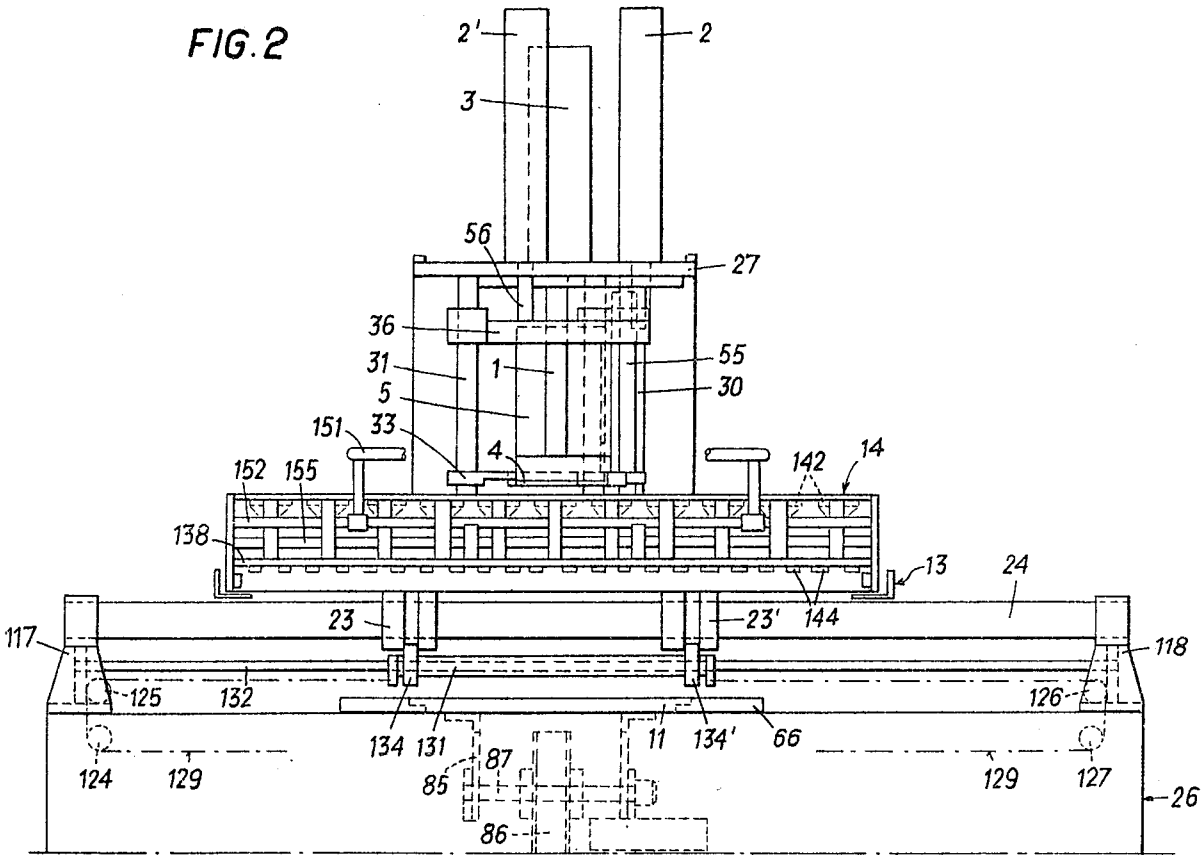

The apparatus is carried by a machine frame 26, which comprises a top plate 27 resting on four columns 28–31. Columns 28, 29, 31 are secured at their lower ends in a die plate 32, which is carried by a baseplate 66, which is adjustably connected to the machine frame 26. The column 30 is inserted in a plate 33, which is held by column 29.

The top plate 27 carries two hydraulic actuators 2, 2′ for operating an angled blanking knife 5, which has two vertical edges formed each with a milled angle-section groove 5′ or 5″, which receives a mating guide bar 8 or 8′, which guides the knife 5 during its cutting movement so that the knife cannot be pushed ahead. The angled blanking knife 5 is provided at its lower end with a wedge-shaped knife edge 5A, which tapers toward the rear side of the knife. At its top end, the angled knife is secured by screws 53 to a knife holder 36, which conforms to the angled shape of the knife. The knife holder 36 has a ledge 37 which protrudes over one-half of the thickness of the knife. The knife holder is movable along the columns 29, 30, 31 by the piston rods 40, 40′ of the actuators 2, 2′.

A carrier plate 41 consisting of a flat steel bar is disposed between the knife holder 36 and the top plate 27 and carries a hydraulic actuator 3, which serves to operate a replaceably mounted punch plate, which is connected to the piston rod 42 of the actuator 3 and cooperates with a punching die 9. The carrier plate 41 extends diagonally to the angled blanking knife 5. For the sake of clearness, those parts which are arranged above the knife holder 36 are indicated only by dotted lines in FIG. 4. The carrier plate 41 is carried by two longitudinally spaced apart straps 43, 44, which are secured by screws 48, 49 and 50, 51, respectively, to the underside of the top plate 27 and force the carrier plate 41 against the plate 27 so as to hold the carrier plate in its adjusted position. As the distance between the screws 48, 49 and 50, 51 exceeds the width of the plate 41, the screws can be loosened and the plate 41 can then be pivotally adjusted about the axis of the column 30 for a purpose which will be explained hereinafter. The plate 41 is also longitudinally adjustable and for this purpose is provided at its end which is adjacent to the column 30 with an open slot 45, which extends along the longitudinal center line of the plate 41. The column 30 guides the corner of the knife holder 36. The slot defines two prongs 38, 39 of a form, which embraces a bushing 46, which extends from the strap 44 and is guided by the column 30.

Figure 3:
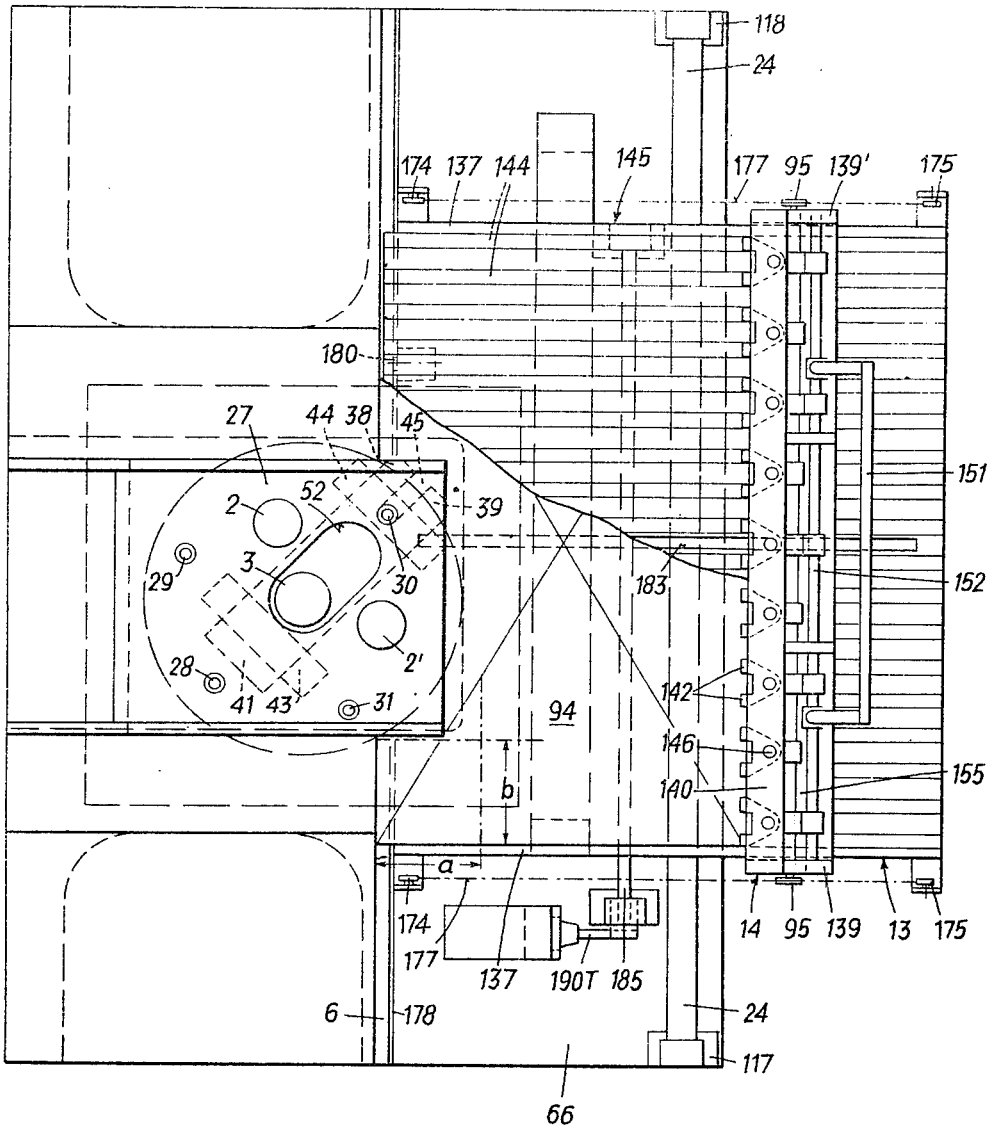
Figure 3A:
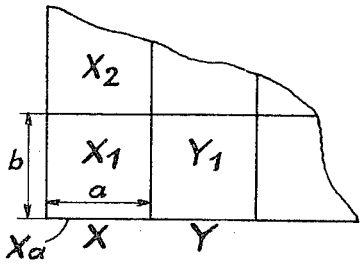
Figure 5:
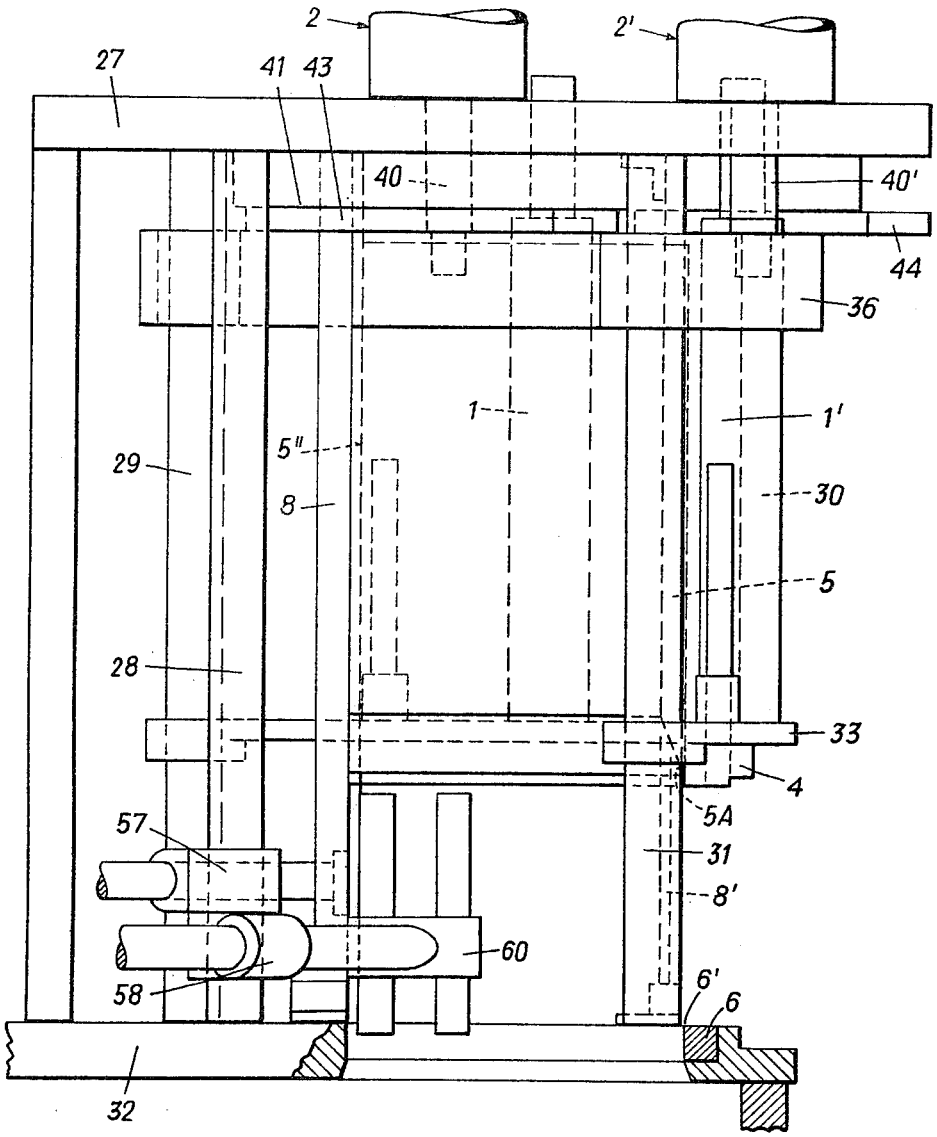

The actuator 3 with its piston rod 42 and the punch plate 7 are not shown in FIG. 5 for the sake of clearness. As is indicated in FIG. 3, the cylinder 3 extends through a substantially elliptical aperture 52 in plate 27. The width and length of the aperture 52 are selected so that the above-mentioned adjustments of plate 41 are not obstructed.

The plate 33 is similar in configuration to the knife holder 36 so that it does not extend into the path of the angled knife 5. Two hydraulic actuators 1, 1' are secured between the plate 33 and the top plate 27 and serve to operate an angled pressure beam 4, which like the plate 33 has approximately the same angled configuration as the knife 5 so that the beam does not obstruct the movement of the knife 5. The rear surface of the angled knife 5 is in sliding contact with and guided by the inside edge of plate 33. Each of the two arms 4', 4'' of the beam 4 is connected to a piston (not shown) of one of actuators 1, 1'. The pressure beam 4 is guided by columns 54, 55, 56. Columns 54 and 56 guide the ends of the arms 4', 4''. Column 55 guides the corner of the beam.

Figure 4:
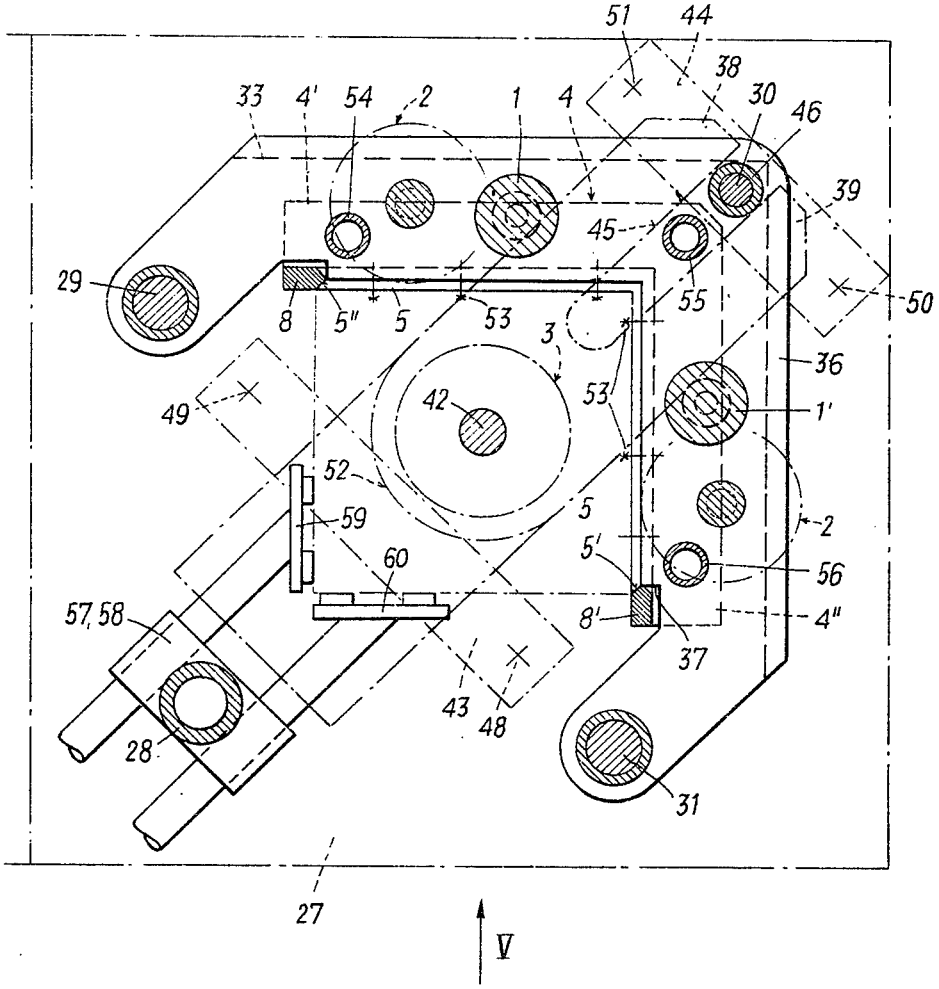

As is apparent from FIGS. 4 and 5, two pivoted brackets 57, 58 arranged one over the other surround the column 28, and sheet stops 59, 60 are longitudinally adjustably mounted in said brackets, which have been omitted in FIG. 1 for the sake of clearness.

The angled blanking knife 5 cooperates with a backing bar 6, which has the same configuration as the knife and is also replaceably mounted in the stationary cutting die plate 32.

A punching die 9 cooperates with the punch plate 7 and has a knife edge 9' which is disposed under the knife edge 6' of the backing bar 6. In the present case the punching die 9 is rectangular and is provided at its lower end with a profiled peripheral rim 62, by which the punching die 9 is supported on all four sides on vises 10. The latter have vertically adjustable jaws 63, which permit of a readjustment of the die when the knife edge 9' has been reground so that the die has been reduced in length. The jaws 63 are mounted by means of screws 65 in carriages 64 to be adjustable transversely to the longitudinal axis of the die 9. The knife edge 9' tapers outwardly in wedge shape and is spaced from the backing bar 6 so that the knife edge 5A of the angled blanking knife 5 can enter between the punching die 9 and the backing bar 6.

Troughs 12 for receiving cuttings are secured to the sides of the punching die 9. These cuttings are pneumatically removed from said troughs.

Figure 6:
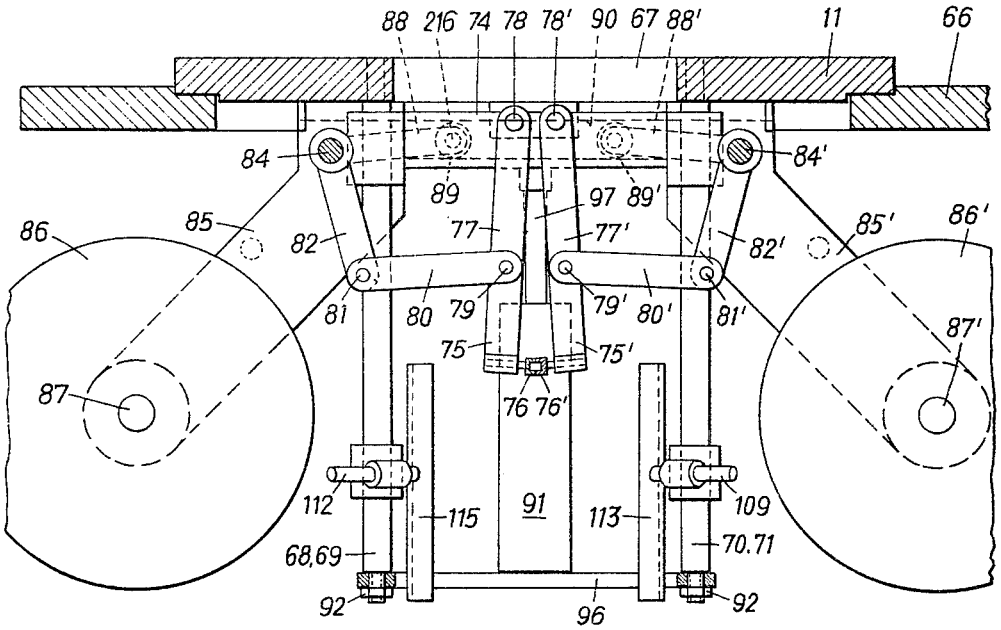
FIG. 6 is an enlarged sectional view taken on line VI—VI in FIG. 7 and shows the wrapping means of the apparatus. These wrapping means have been shown in a simplified form in FIG. 1.
Figure 8:
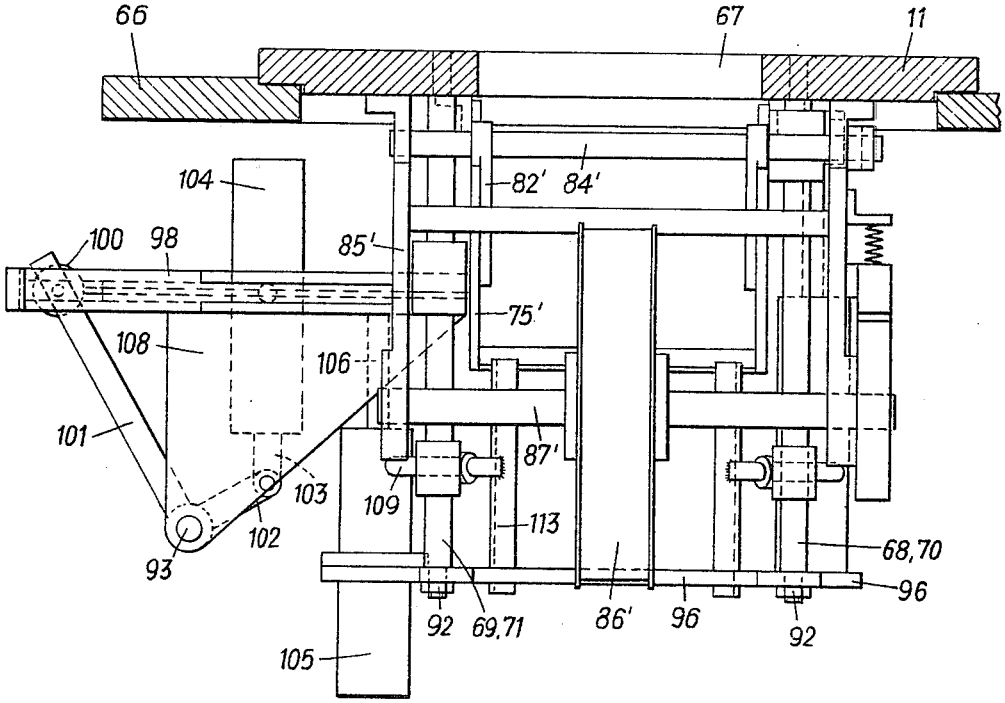
FIG. 8 is a side elevation showing the wrapping means viewed in the direction of the arrow VIII in FIG. 7.
Figure 7:
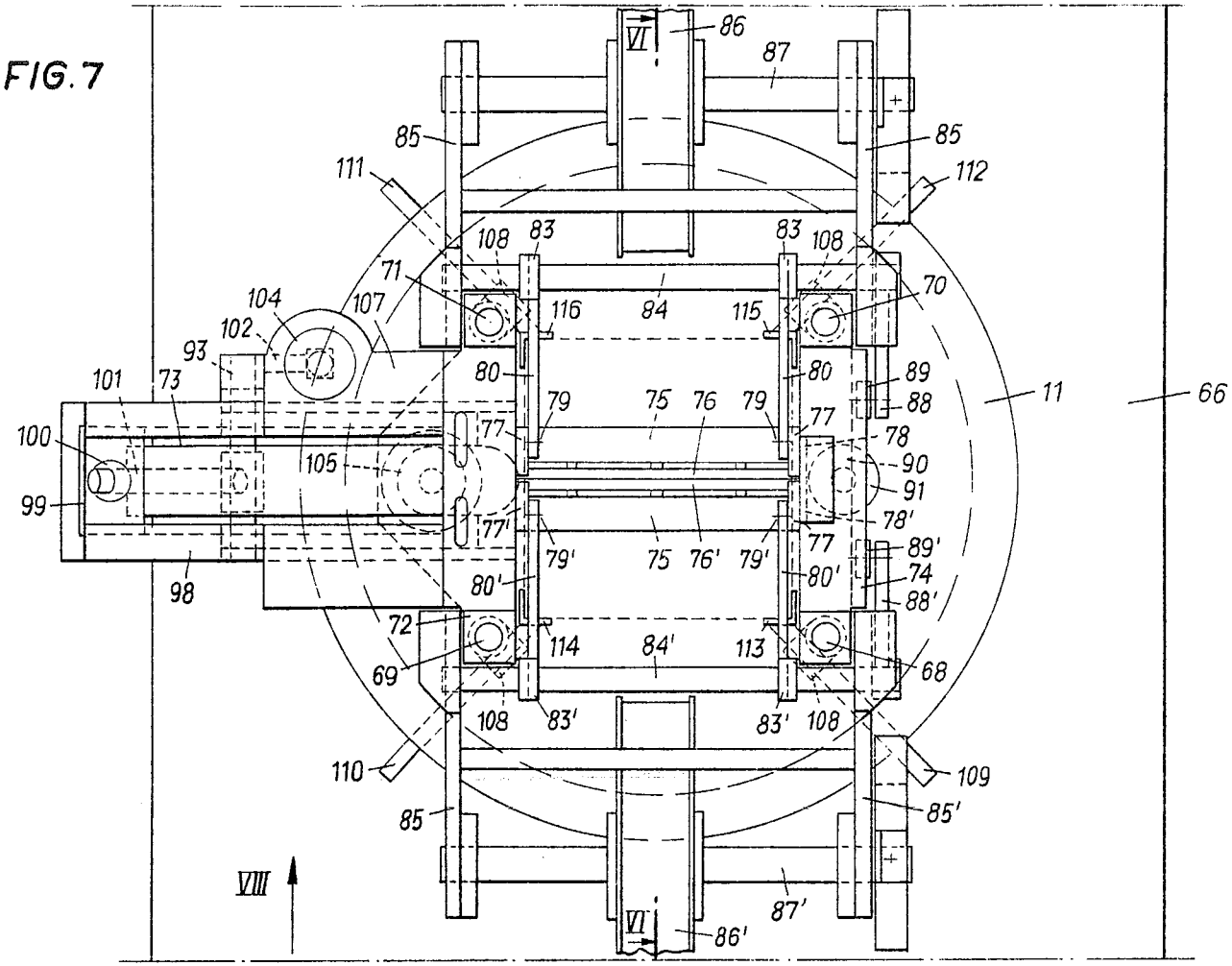
FIG. 7 is a top plan view showing the wrapping means.

The vises 10 are secured to a turntable 11, which is adjustably mounted on the baseplate 66 and has a central bore 67 (FIGS. 6, 8), which provides a passage for the punched labels. For columns 68–71 are secured to the underside of turntable. Two of said columns, numbered 69, 71, provide vertical guides for a bridge 72, which carries a separating blade 73. The other two columns, numbered 68, 70, constitute vertical guides for a bridge 74 for moving welding tongs 17. As is apparent from FIGS. 6 and 7 the welding tongs 17 comprise two jaws 75, 75', which are provided with spring-cushioned welding lips 76, 76' and are connected on both sides to mounting arms 77, 77', which are pivoted each to a fixed point 78 or 78'. Each mounting arm 77 or 77' is pivotally connected at 79 or 79' to a link 80 or 80', which is pivotally connected at 81 or 81' to a link 82 or 82', which is provided with a bushing 83 or 83' at the end which is remote from the pivot 81 or 81'. Each bushing 83 or 83' is non-rotatably connected to a shaft 84 or 84', which is rotatably mounted at both ends in side plates 85 or 85'. These side plates are secured to the turntable 11. Shafts 87 or 87' carry respective tape rolls 86 or 86' and are rotatably mounted in side plates 85 or 85' at the free ends thereof. One end of an additional link 88 or 88' is non-rotatably connected to each shaft 84 or 84' at that end thereof which is adjacent to the bridge 74. A roller 89 or 89' is rotatably mounted in each link 88 or 88' at the other end thereof and is guided in a horizontal slot 90 of the bridge 74. The bridge 74 is moved up and down by a hydraulic actuator 91, which is mounted on a plate 96, which is connected to the lower ends of columns 68–71 and locked by nuts 92. The actuator 91 has a piston rod 97 which is connected to the bridge 74.

The bridge 72 (FIGS. 7 and 8) have a laterally protruding track 98 for a carriage 99, which slidably engages said track 98 on both sides and carries the separating blade 73. A ball 100 is centrally mounted in the carriage 99 for rotation in all directions. A coupling rod 101 extends through the ball 100 and is slidable therein and is non-rotatably connected to a shaft 93. The latter is operatively connected by a link 102 to a piston rod 103 of a hydraulic actuator 104, which is operable to impart to the rod 101 a pivotal movement about the axis of the shaft 93. A pressure fluid actuator 105 is mounted on the plate 96 and has a piston rod 106, which is connected to the bridge 72. The actuator 105 is operable to move the bridge 72 up and down. The actuator 104 is carried by a platform 107, which is connected to the track 98 and to the bridge 72 and carries depending side plates 108, in which the shaft 104 is rotatably mounted.

Bearing bushings 108 are mounted on the columns 68–71 and are vertically adjustable and adapted to be fixed in their adjusted position. Rods 109–112 are slidably mounted in the bushings 108 and adapted to be fixed in their adjusted position and extend tangentially with respect to the columns 68–71. Vertical angled guides 113–116 are secured at the mutually adjacent ends of the rods 109–112.

A belt conveyor 19 is disposed below the previously described arrangement and is moved in the direction of the arrows C in FIG. 1. A collecting trough 18 is provided at the delivery end of the conveyor 19.

A stacking table 13 (FIGS. 1, 2, 3, 9, and 10) is provided and serves to carry the stacks to be punched. The stacking table 13 is mounted by means of sliding-surface bearings 23, 23' and spherical sleeves 136, 136' on a sliding rod 24, which at its ends is mounted in bearing brackets 117, 118. The table 13 is intermittently adjustable along the rod 24 and is intermittently pivotally movable about said rod. A longitudinal movement along the sliding rod 24 is imparted to the table by a brake motor 20, which is secured to the baseplate 66, which carries also the bearing brackets 117, 118. The motor 20 is provided with a solenoid brake 21 and by means of a transmission 119 and a belt 120 drives a belt pulley 121, which is coaxial with and operatively connected to a chain sprocket 122. The latter serves to drive a chain 129, which is trained around deflecting sprockets 123–128. The chain 129 is connected at its ends to the ends of a retaining tube 131, which is mounted by means of spherical sleeves 133, 133' on a shaft 132, which at its ends is mounted in the bearing brackets 117 and 118. The tube 131 is movable along the shaft 132. At its ends, the retaining tube 131 carries angular-contact ball bearings 134, 134', which have an outer race received by a peripheral groove 135 or 135' of the sliding-surface bearing 23 or 23' of the table so that they maintain the connection between the sliding-surface bearings 23, 23' and the retaining tube 131 as the table 13 is pivotally moved about the sliding rod 24.

The table 13 carries a carriage 14, which in a direction that is transverse to the direction of movement of the table is movable along two parallel edge rails 137, 137'. The carriage 14 basically comprises a baseplate 138, sideplates 139, 139' which are extended to depend from the baseplate 138, and a cover bar 140, which connects the top edges of the side plates. Gripper 141, 142 are provided, which serve to retain a stack of paper sheets and which form a plurality of pairs of superimposed grippers. A number of spaced apart pairs of grippers constitute a set. The lower grippers are secured in a recess 143 of the baseplate 138 and depend from the baseplate only to a small extent and can be guided in mating grooves 144 of a table top 145, which is disposed between the rails 137, 137'. The upper grippers 142 are adjustable along axially movable, vertical tubes 146, which are biased by a spring 150, which is stressed between the tube plate 147 and the head 148 of a bolt 149, which extends through the tube plate 147 and is screwed into the baseplate 138 of the carriage 14. A hand lever 151 having a U-shaped handle is operable to actuate the tubes 146 in unison and is non-rotatably connected to a shaft 152, which is mounted in the side plates 139, 139' of the carriage 14. The shaft 152 is provided with eccentric cams 153, which cooperates with follower plates 154 carried by a common shaft 155, which is disposed below the shaft 152. The shaft 155 is provided with lifting plates 156, which are diametrically opposite to the follower plates 154 and engage the tubes 146 at their lower ends. Each upper gripper 142 comprises two gripper fingers 142A, 142B, which constitute a fork and are disposed over respective lower grippers 141. A stop bar 157 is disposed between the gripper fingers 142A, 142B of each fork and is held at its ends by the cover bar 140 and the baseplate 138.

The carriage 14 is connected to the rails 137, 137' by rollers 158, 158' and 159, 159', which have such an oblique orientation that one pair of rollers 158, 158' are supported on top in respective guide grooves 160 and 160' of the side plates 139, 139' of the carriage 14 and at diametrically opposite points on respective lower guiding surfaces 161 and 161' of the rails 137 and 137' of the table 13 so that this pair of rollers take up forces acting downwardly on the carriage 14. Additional rollers 159 or 159' are disposed between the rollers 158 and 158' and are arranged each in mirror symmetry to the adjacent roller 158 or 158' and bear on top against respective upper guiding surfaces 162 or 162' of rails 137 and 137' and are supported from below in respective guiding grooves 163 and 163' of the side plates 139, 139' to prevent a lifting of the carriage 14 from the table 13.

An intermittent movement is imparted to the carriage 14 by a motor 164, which is secured to the underside of the table 13 and drives via a worm 165, a worm wheel 166, and a ribbed belt 167 a gear 168 in mesh with said belt. The gear 168 is secured to a shaft 171, which is mounted in bearing brackets 169, 170 carried by the table 13. A chain sprocket 172 non-rotatably mounted on the shaft 171 drives a chain 177, which is trained around deflecting sprockets 173, 174, 175 and 176 and is secured to the carriage 14 at 95. As is apparent from FIGS. 10A and 10B, a chain drive 172–177 is provided on each side of the carriage.

Along that edge which faces the above-described blanking and punching means, the table 13 is guided on a bar 178, which carries also the fixed backing bar 6 and constitutes a part of the die plate 32 (FIG. 1). As is apparent from FIG. 9, the bar 178 contains a series of rollers 179, which support the table 13. Spring-biased ball bearings 180 are secured to the underside of the table top 145 and are adjustable in the direction of movement of the carriage 14 and normally engage a lower abutment surface 181 of the bar 178 to prevent a lifting of the table 13 and a pivotal movement thereof about the sliding rod 24. When a hand lever or the like has been operated to move the ball bearings 180 against the abovementioned spring bias out of the range of the bar 178 and its abutment surface 181, the table 13 can be pivotally moved to the position indicated by dotted lines in FIG. 1.

Figure 11:
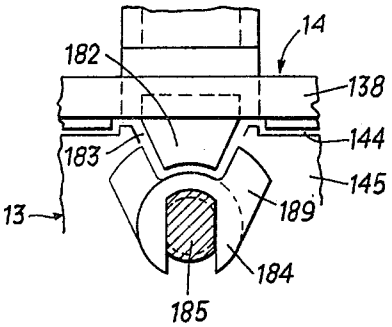
FIG. 11 is an enlarged view showing the means for the sequential control of the carriage according to FIG. 10B.
Figure 10B:
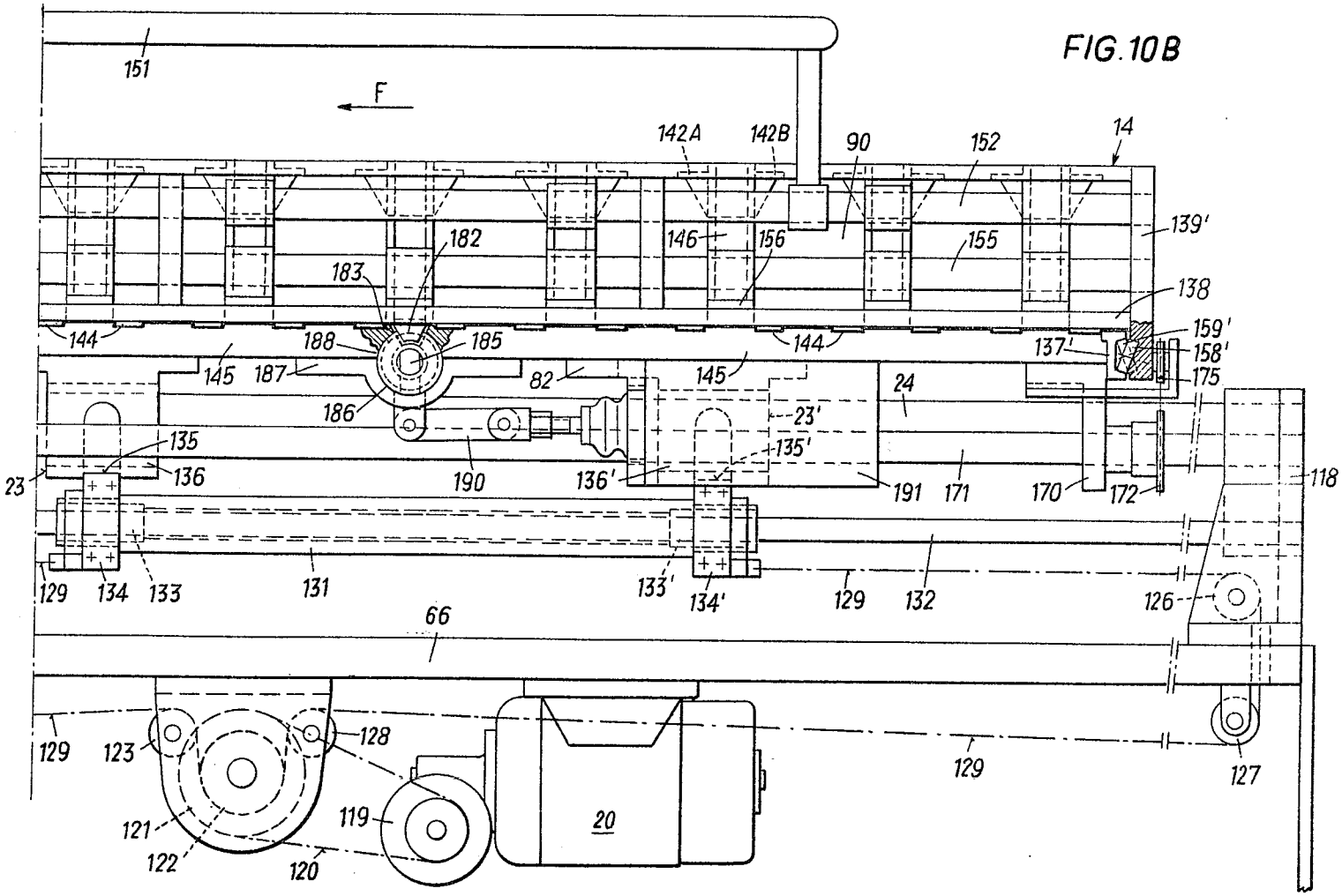

To impart an intermittent movement to the carriage 14, a sequential control mechanism is provided. The same comprises a striker 182, which depends from the underside of the baseplate 138 of the carriage 14 and which extends through a slot 183 (FIGS. 3, 10B, and 11) of the table top 145. This slot 183 extends in the direction of movement of the carriage 14. The striker 182 is adapted to cooperate with adjustable stop members 184 (FIG. 11), which are carried by a threaded rod 185. Bushings 186 are screwed on the ends of the rod 185 and hold the same replaceably between detachably mounted bearing shells 187 and mating bearing recesses 188 in the table top 145. The threaded rod 185 is laterally flattened so that the stop members 184 can be applied to the threaded rod 185 in a straddling position, as is shown in FIG. 11, and nuts threaded on the rod 185 on both sides of each stop member 184 can be tightened to fix each stop member 184 in position. The spacing of the stop members 184 on the threaded rod 185 corresponds to the desired movements of the carriage. Each stop member 184 comprises a lug 189. The lugs 189 of successive stop members 184 extend in alternation on the left and right of the center plane so that the lugs define between them a free passage for the striker 182. At least one of the end bushings 186 is connected by a linkage 190 to drive means 191, which are controlled by a double-acting solenoid and which intermittently rotate the threaded rod 185 forth and back so that the lugs 189 of the stop members 184 are moved in alternation into the path of the striker 182. The threaded rod 185 is mounted to be spring-cushioned in an axial direction and performs a slight axial movement when the striker 182 strikes a lug 189 of a stop member 184. In response to this slight axial movement, a microswitch causes the carriage 14 to stop. A similar control mechanism is provided for the intermittent movement of the table 13. Corresponding parts of the control mechanism for the table are designated in FIGS. 1 and 9 with the same reference characters and the suffix "T". The drawing shows the striker 182T, the threaded rod 185T, stop members 184T, the linkage 190T and the drive means 191T.

Figure 9:
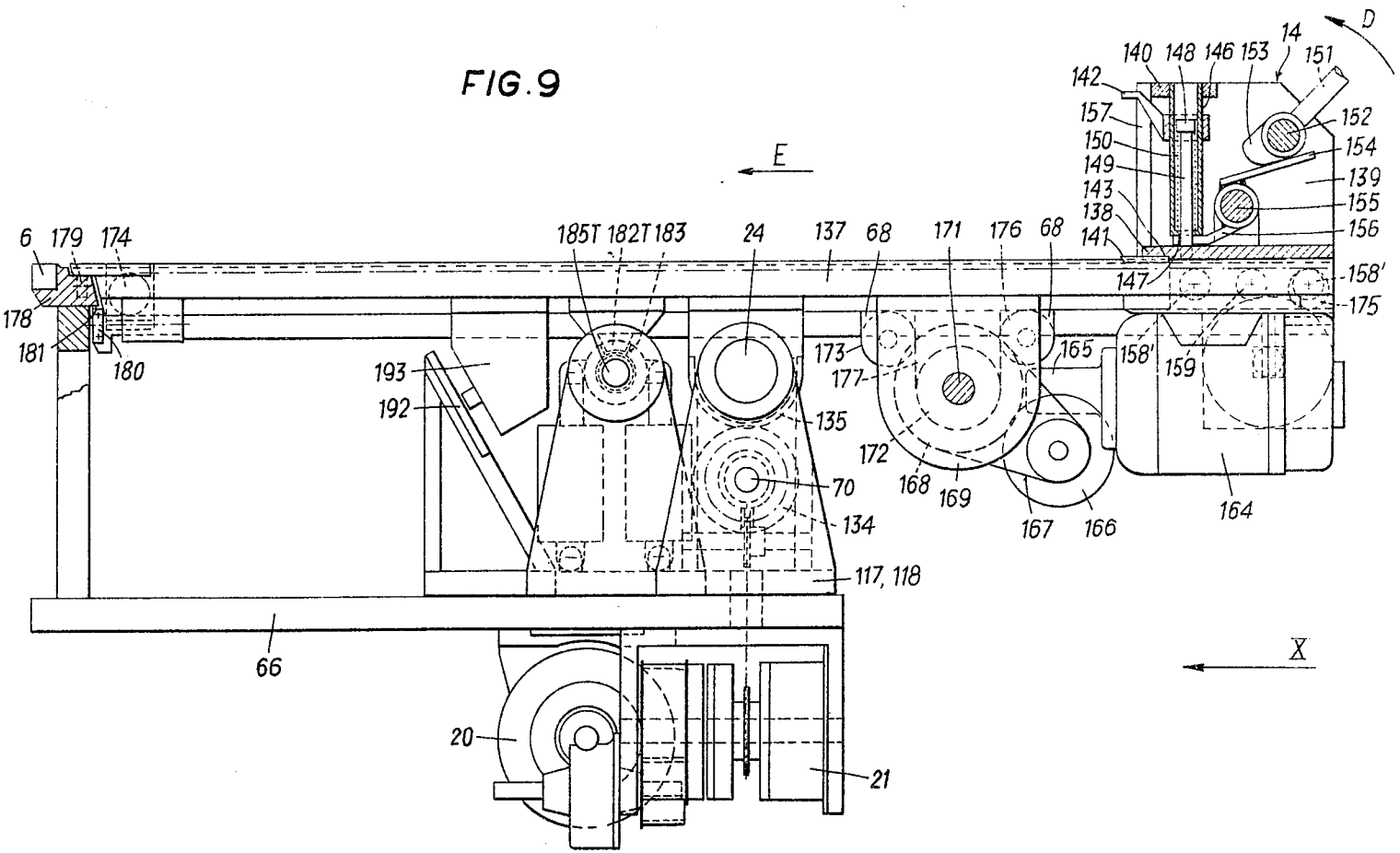
FIG. 9 is an enlarged view showing in more detail a portion of FIG. 1 with the feed table.
Figure 10A:
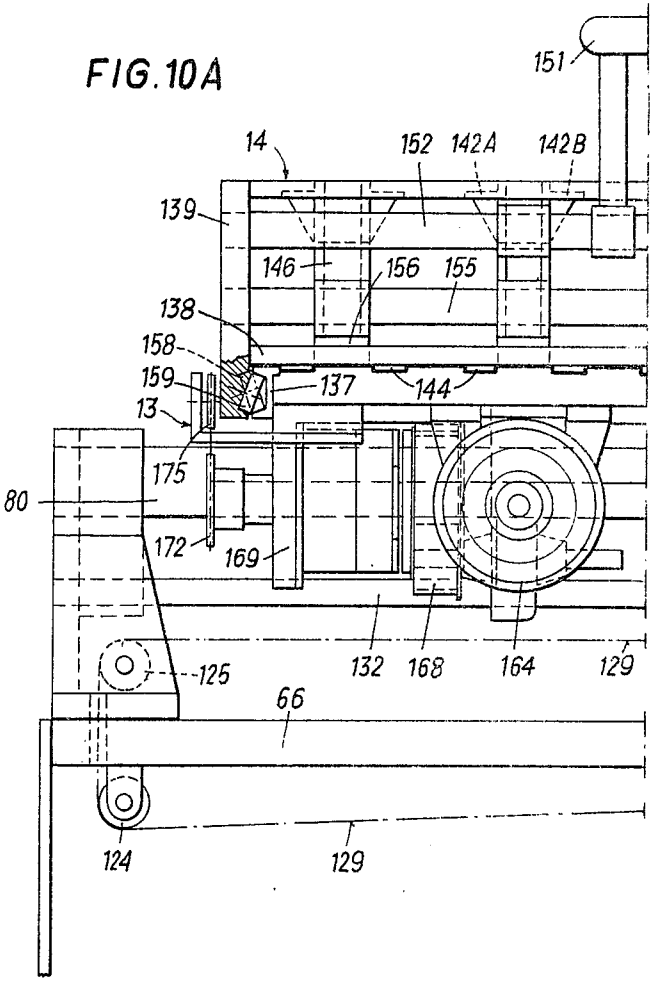
FIGS. 10A and 10B are an elevation taken in the direction of arrow X in FIG. 9.
Figure 12:
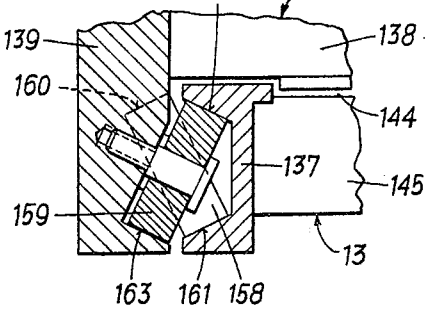
FIG. 12 is an enlarged view showing the connection between the carriage and rails according to FIGS. 10A and 10B.

The above-described control mechanism for the intermittent movements of the table 13 and the carriage 14, which control mechanisms comprise strikers and stop members, may be replaced or supplemented by different control means, which may comprise, e.g., a magnetic tape 192 and a reading head 193, such as is indicated in FIG. 9 for the control of the table movement.

The mode of operation and control of the above-described apparatus will now be described. It will be assumed that labels are to be severed from a stack of sheets 94 and are to be transferred in the form of wrapped stacks to a collecting station. For this purpose, the stack must be cut into blanks having a width "*a*" and a length "*b*", and these blanks must be punched to form the labels. To perform this program, the stop members 184 and 184T are set on the threaded rods 185 and 185T so as to be spaced apart by the distances *a* and *b*, respectively (FIG. 3). This work is performed outside the apparatus. As a result, the carriage will perform intermittent movements corresponding to the length *a* and the table will perform intermittent movements corresponding to the width *b* and in a direction which is at right angles to the movement of the table. The rods 185 and 185T are then mounted in their operative positions on the table 13 or in bearing brackets 194' carried by the table, respectively. Instead of this preparatory work, corresponding marks may be recorded on the magnetic tape 192.

When the table is in its extreme end position and it is desired to load the table with the stack from which the labels are to be made, the table is pivotally moved to the inclined position indicated with dotted lines in FIG. 1 so that the carriage 14 is in its lowermost position. The hand lever 151 is then pivotally moved in the direction of the arrow D (FIGS. 1 and 9) so that the grippers 143 raise the tubes 146 and the stack 94 can now be engaged with the stop bars. The hand lever 151 is then released so that the springs 150 move the tubes 146 to their initial position and thus urge the gripper fingers 142A, 142B of the grippers 142 against the stack 94 to retain the same in position. The table 13 is then moved to its operating position shown in FIG. 1. The table rollers are blocked and the drive motors are energized to start the apparatus. As a result, the cycle of operations is initiated by an electrical or electronic control system, which is well known to a person skilled in the art. Only the most essential parts of this control system have been described. The control system first causes the engagement of a clutch, which is associated with the motor 164 and is not shown. As a result, the chain 177 is driven to move the carriage 14 in the direction of the arrow E (FIG. 9). This causes the first field $X_1$ which is to be blanked to move into the range of the knife 5. The carriage 14 will be arrested as soon as the striker 182 of the carriage 14 has struck on the lug 189 of the first stop member 184 so that the further movement of the striker is obstructed and the threaded rod is caused to operate the above-mentioned microswitch. In this position that edge of the field $X_1$ which is the leading edge with respect to the direction of movement of the carriage 14 engages that knife edge portion of the angled blanking knife 5 which is parallel to said leading edge. At this instant, the control system causes the table to move in the direction F by the distance *b*, which is determined by the position of the first stop member 184T on the threaded rod 185T. This stop member cooperates with the striker 182T carried by the table 13. This control is similar to that of the carriage 14. When the carriage has been arrested, the field $X_1$ is disposed exactly under the angled cutting knife 5. At this instance the hydraulic actuators 1, 1' cause the pressure beam 4 to descend so that the stack 94 is fixed in position for the cutting of the blank $X_1$. The hydraulic cylinders 2, 2' are then operated to lower the angular blanking knife 5 so that the blank $X_1$ is cut off and by the wedge action of the knife edge is forced in a diagonal direction against the stops 59, 60, which align the blank for the subsequent punching operation. For this punching operation, the punch plate 7 is lowered first. As soon as the punch plate has contacted the blank to force the latter against the punching die, the angled blanking knife 5 is raised while the blank is being punched. The punched stack of labels is held by its frictional contact with the lateral guides and is pushed down by the subsequent stacks of labels. The waste drops into the waste-collecting troughs 12 and is pneumatically sucked off.

Thereafter the stacks of labels are wrapped and the stack of sheets is moved into the position for the next blanking and punching sequence. When a blanking and punching sequence has been completed, the pressure beam 4 is raised and at the end of its upward stroke operates a microswitch to initiate these wrapping and positioning operations. To reposition the stack 94, the drive means 191T impart an angular movement to the threaded rod 185T so that that lug of a stop member 184T which was previously in the path of the striker 182T is moved out of said path and the lug of the next following stop member 184T enters the path of the striker 182T. The carriage 14 then moves the next field $X_2$ under the blanking knife 5. This operation is repeated until the last field of the row X has been positioned, and a limit switch is then operated to reverse the sense of friction of the drive motor 20 for the table. When the cutting and punching operations have then been completed and the clutch associated with the table-driving motor is engaged, the table returns to its initial position and a control operation which is similar to that for the table causes the carriage to advance by the distance *a* so that the fields of the next row Y can be blanked and punched.

The separating blade 73 is operated to separate from the stack of punched labels a portion which is to be wrapped. For this purpose the actuator 105 is operated to raise the bridge 72 while the separating blade 73 is in a retracted position. The actuator 104 is then operated to push the separating blade into the stack of labels and the actuator 105 is operated to return the bridge 72 to its initial position. As a result, part of the stack of punched labels is depressed and the tapes of thermoplastics materials which extend under the stack and which have been withdrawn from the two tape rolls 86, 86' and joined by welding at their free ends are pulled at the same time so that when the bridge 72 is in its lowermost position and the bridge 74 is forced upwardly by the actuator 91 to the position shown in FIG. 6 the welding lips 76, 76' can be moved against each other to form a seam weld in the tapes over the stack of labels and to cut through the tapes at the same time so that the wrapped stack can be discharged and the ends of the tapes from both rolls 86, 86' are again joined by welding at their ends and can receive the next following stack portion. The wrapped stack of labels is carried by the belt conveyor 19 to the collecting station 18.

As has been mentioned before, the carrier plate 41 and the cylinder 3 secured thereto may be adjusted when the screws 48–51 have been loosened. This enables an adaptation to the shape and size of the punching die 9 and the punch plate 7 so that any desired working program can be performed without a unilateral loading of the tools.

The mode of operation which has been described is only one of the purposes for which the apparatus according to the invention can be used. For instance, the electrical control system may be rendered inoperative and the table and carriage may be moved by hand. Finally, the control system may be hydraulic rather than electrical.

What is claimed is:

1. Apparatus for manufacturing labels from a stack of sheets of paper and for wrapping stacks of said labels, comprising a table for supporting said stack of sheets of paper, severing means comprising blanking means for cutting a stack of blanks from said stack of sheets of paper and punching means for punching a stack of labels from said stack of blanks in the position in which said blanks have been formed, guide means for vertically guiding said labels to wrapping means, said blanking means and punching means, guide means and wrapping means being arranged in said order in a vertical succession adjacent to said table, said table being provided with feeding means, said table and feeding means cooperating to intermittently feed said stack of sheets of paper in a first direction in steps corresponding to a first dimension of each of said blanks toward said means arranged in said vertical succession, and repeatedly feed said stack of sheets in a second direction, which is transverse to said first direction, in steps corresponding to a second dimension of said blanks, so that stacks of blanks are severed in successive rows from said stack of sheets of paper.

2. Apparatus according to claim 1, characterized in that the table is disposed outside the range of the severing means and is guided near the latter along a bar and carries a carriage, which extends parallel to said bar and comprises grippers for holding said stack of sheets of paper carried by said table in position in that said grippers engage said stack of sheets of paper at the edge which is remote from the severing means, said carriage being operable to intermittently move said stack of paper toward said severing means, the advance of said carriage being controlled in dependence on the operation of said severing means.

3. Apparatus as set forth in claim 1, characterized in that the severing means comprise a pressure beam, which is adapted to be forced against said stack of sheets of paper at the beginning of the blanking and punching sequence, a subsequently descending, angled blanking knife, and a punch plate which succeeds said blanking knife and cooperates with a fixed punching die, which also constitutes a guide for guiding the punched stacks of labels into the wrapping means disposed underneath, said pressure beam, blanking knife, and punch plate being movable one in the other substantially at right angles to the plane in which the stack of sheets of paper generally extends, and that said wrapping means comprises two vertically movable bridges for moving a separator blade to separate a stack of labels to be wrapped and welding tongs for welding two wrapping tapes near their leading ends and for severing said wrapping tapes beyond the resulting welded joints.

4. Apparatus according to claim 1, characterized in that the table comprises at least two spaced apart sliding-surface bearings, which are slidably mounted on a sliding rod, each of said sliding-surface bearings has a peripheral surface formed with a concentric groove, which receives coupling elements of drive means for moving the table, and the table is pivotally movable about the sliding rod so that said coupling elements are guided by said grooves.

5. Apparatus as set forth in claim 4, characterized in that the coupling elements comprises ball bearings, which are mounted on a tube that is guided by a shaft which is parallel to the sliding rod, and the ends of a chain for moving the table are connected to said tube.

6. Apparatus according to claim 1, characterized in that two replaceably mounted rods are provided to respectively control the table and a carriage movable on said table, each of said rods is adapted to be selectively set with stops and is connected with drive means for successively moving said stops of said rod into the path of a striker carried by said table or carriage, respectively.

7. Apparatus according to claim 6, characterized in that each of said rods has a lateral flat and is provided with screw threads and carries straddling stop members which have lugs that are engageable by said striker of said table or carriage, respectively, successive ones of said lugs being arranged in alternation on one side and the other of a center line and defining a passage for the striker of the table or carriage, respectively, that each of said threaded rods performs successive angular movements in opposite directions and is mounted to be resiliently cushioned in its longitudinal direction and cooperates with a switch which causes a stoppage of the carriage or table, respectively, whenever a stop member of said rod has been struck by the associated striker.

8. Apparatus as set forth in claim 2, characterized in that the carriage is guided along longitudinal rails of the table by means of rollers, which are inclined in opposite senses with respect to a vertical center plane and comprise rollers which support the carriage from below and rollers which hold down the carriage on said table.

9. Apparatus as set forth in claim 3, characterized in that the pressure beam, the blanking knife and the punch plate are operable by associated fluid pressure actuators, and the actuator associated with the punch plate is adjustable transversely to the direction of movement of the punch plate.

* * * * *